US006223664B1

(12) United States Patent
Gamano et al.

(10) Patent No.: US 6,223,664 B1
(45) Date of Patent: May 1, 2001

(54) BUTTONHOLE SEWING MACHINE

(75) Inventors: Jun Gamano, Okazaki; Takashi Kondo, Obu; Etsuzo Nomura, Kasugai; Akihiro Funahashi, Handa; Yukio Nishida, Kuwana; Itaru Shibata, Tajimi, all of (JP)

(73) Assignee: Brother Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/541,054

(22) Filed: Mar. 31, 2000

(30) Foreign Application Priority Data

Apr. 30, 1999 (JP) ..... 11-124302

(51) Int. Cl.[7] ..... D05B 3/06; D05B 21/00
(52) U.S. Cl. ..... 112/73; 112/447; 112/451
(58) Field of Search ..... 112/73, 65, 68, 112/447, 451, 475.25

(56) References Cited

U.S. PATENT DOCUMENTS 4,159,688 7/1979 Garron et al. .
6,044,781 * 4/2000 Noeltge ..... 112/68

FOREIGN PATENT DOCUMENTS 6-285280 10/1994 (JP) .

* cited by examiner

*Primary Examiner*—Peter Nerbun
(74) *Attorney, Agent, or Firm*—Oliff & Berridge, PLC

(57) ABSTRACT

In a buttonhole sewing machine, a sewing mechanism and a feed bracket are controlled to form a buttonhole defined by settings, such as zigzag stitch length, zigzag pitch, bar-tack length, bar-tack pitch, and cutter space. The buttonhole can be set on the operation panel and changed to various shapes by changing the above settings. In particular, the left and right zigzag stitch widths can be set differently, and the front and rear bar-tack lengths can be also set differently. Thus, the balance of the buttonhole can be finely adjusted.

24 Claims, 20 Drawing Sheets

BUTTONHOLE SEWING MACHINE

BACKGROUND OF THE INVENTION

1. Field of Invention

The invention relates to a buttonhole sewing machine capable of forming a stitched buttonhole having a pair of left and right zigzag stitch portions placed at both sides of a defined buttonhole and a pair of bar-tack stitch portions disposed at both ends of the zigzag stitch portions on a work cloth.

2. Description of Related Art

A conventional buttonhole sewing machine typically includes a feed bracket that feeds a work cloth, a sewing device that creates stitches on the work cloth, and a sewing controller that controls the feed bracket and the sewing device to form a stitched buttonhole having a pair of left and right zigzag stitch portions placed at both sides of a buttonhole to be formed and a pair of bar-tack stitch portions disposed at both ends of the zigzag stitch portions. In such a buttonhole sewing machine, the sewing controller controls the feed bracket and the sewing device, the work cloth is fed and stitches are made thereon. Thus, a stitched buttonhole 70 (which will be later described in detail), as shown in FIG. 6, can be created.

However, the buttonhole sewing machine does not provide for minute settings regarding buttonhole shapes. For example, the stitch width of the needle to sew the zigzag stitch portions 71,72 (hereinafter referred to as a zigzag width) was fixed to a predetermined value. In short, the buttonhole sewing machine provides for the settings of the size of the stitched buttonhole 70 and the stitch pitch, but the settings of the shape of the stitched buttonhole 70 and the balance between the left and right zigzag stitch portions 71,72 and between the front and rear bar-tack stitch portions 73,74 were not taken into consideration. As a result, problems have occurred. For example, the widths of the left and right zigzag stitch portions 71,72 are usually set so as to be equal to each other. According to the tension of the needle thread, the finish looks as though the widths of the left and right zigzag stitch portions 71,72 are different. However, the buttonhole sewing machine could not correct the balance by means of adjustment. Similarly, it could not correct the balance between the front and rear bar-tack stitch portions 73,74 as if the finish looks as though their widths are different.

When this kind of stitched buttonhole is formed on the work cloth, double sewing, in which the finished stitched buttonhole is sewn again so as to overlap the needle thread on the work cloth, is performed in some cases. However, in double sewing, the needle thread already sewn into the stitches may be broken because the second sewing is made on the same needle points where the first sewing is made. In addition, when double sewing is partially made, a part where double sewing is made and another part where double sewing is not made are different in thickness. Because the conventional sewing machine was provided for a fixed stitched buttonhole pattern only, it could not make the adjustment in proportion to the difference in the stitch thickness.

SUMMARY OF THE INVENTION

The invention was made in consideration of the above circumstances. A first object of the invention is to provide a buttonhole sewing machine capable of minutely setting the shape of a stitched buttonhole. A second object of the invention is to provide a buttonhole sewing machine that can prevent the needle thread from being cut when double sewing is performed. A third object of the invention is to provide a buttonhole sewing machine that can easily adjust the balance of thickness of a stitched buttonhole.

The buttonhole sewing machine, which is intended to accomplish the first object, comprises a feed bracket that feeds a work cloth; a sewing device that forms stitches on the work cloth; a sewing controller that controls the feed bracket and the sewing device so as to form a stitched buttonhole having a pair of zigzag stitch portions placed at both sides of a buttonhole and a pair of bar-tack stitch portions disposed at both ends of the zigzag stitch portions; and a zigzag stitch width setting device that enables the left and right zigzag stitch widths to be set separately; wherein the sewing controller controls the sewing device based on the zigzag stitch width set by the zigzag stitch width setting device so as to cause the sewing device to form the stitched buttonhole having the set zigzag stitch width. Therefore, the buttonhole sewing machine can not only change the shape of the stitched buttonhole, but can also adjust the balance of the left and right zigzag stitch portions.

In a preferred aspect of the invention to accomplish the first object, a buttonhole sewing machine comprises a feed bracket that feeds a work cloth; a sewing device that forms stitches on the work cloth; a sewing controller that controls the feed bracket and the sewing device so as to form a stitched buttonhole having a pair of zigzag stitch portions placed at both sides of a buttonhole and a pair of bar-tack stitch portions disposed at both ends of the zigzag stitch portions; a stitch width setting device that enables a width for the pair of zigzag stitch portions and a width for the front or rear bar-tack stitch portions to be set separately, wherein the sewing controller controls the sewing device based on the zigzag stitch width set by the zigzag stitch width setting device so as to cause the sewing device to form the stitched buttonhole having the set zigzag stitch width. Therefore, the buttonhole sewing machine can minutely change the shape of the stitched buttonhole by separately setting the width for the pair of zigzag stitch portions and the width for the front or rear bar-tack stitch portions. In addition, it can adjust the balance between the front and rear bar-tack stitch widths of the stitched buttonhole.

In another preferred aspect of the invention to accomplish the first object, a buttonhole sewing machine comprises a feed bracket that feeds a work cloth; a sewing device that forms stitches on the work cloth; a sewing controller that controls the feed bracket and the sewing device so as to form a stitched buttonhole having a pair of zigzag stitch portions placed at both sides of a buttonhole and a pair of bar-tack stitch portions disposed at both ends of the zigzag stitch portions; a bar-tack stitch length setting device that enables a length for each of the pair of bar-tack stitch portions to be set separately; wherein the sewing controller controls the sewing device based on the bar-tack stitch portion length set by the bar-tack stitch length setting device and causes the sewing device to form a stitched buttonhole having the set bar-tack stitch lengths. Therefore, the buttonhole sewing machine can minutely change the shape of the stitched buttonhole by setting the length for each of the pair of bar-tack stitch portions separately. In addition, it can adjust the balance between the front and rear bar-tack stitch lengths of the stitched buttonhole.

To accomplish the second object, a buttonhole sewing machine comprises a feed bracket that feeds a work cloth; a sewing device that forms stitches on the work cloth; a sewing controller that controls the feed bracket and the sewing device so as to form a stitched buttonhole having a pair of zigzag stitch portions placed at both sides of a buttonhole and a pair of bar-tack stitch portions disposed at both ends of the zigzag stitch portions; wherein the sewing controller disposes needle points at the start of sewing and needle points at the end of sewing so as not to overlap each other when the start and the end of the stitched buttonhole are disposed on either of the front or rear bar-tack stitch portions and the front and rear bar-tack stitch portions are doubly sewn. Thus, the needle points at the end of sewing do not agree with those at the start of sewing. As a result, the buttonhole sewing machine prevents the needle thread that is already sewn into stitches, from being cut when double sewing is performed.

To accomplish the third object, a buttonhole sewing machine comprises a feed bracket that feeds a work cloth; a sewing device that forms stitches on the work cloth; a sewing controller that controls the feed bracket and the sewing device so as to form a stitched buttonhole having a pair of zigzag stitch portions placed at both sides of a buttonhole and a pair of bar-tack stitch portions disposed at both ends of the zigzag stitch portions; a mode switching device that switches over a mode in which only the zigzag stitch portions are sewn doubly and a mode in which both bar-tack stitch portions and the zigzag stitch portions are sewn doubly when the buttonhole is sewn doubly. Therefore, the buttonhole sewing machine can easily adjust the thickness balance among the zigzag stitch portions and bar-tack stitch portions.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

Figure 1:
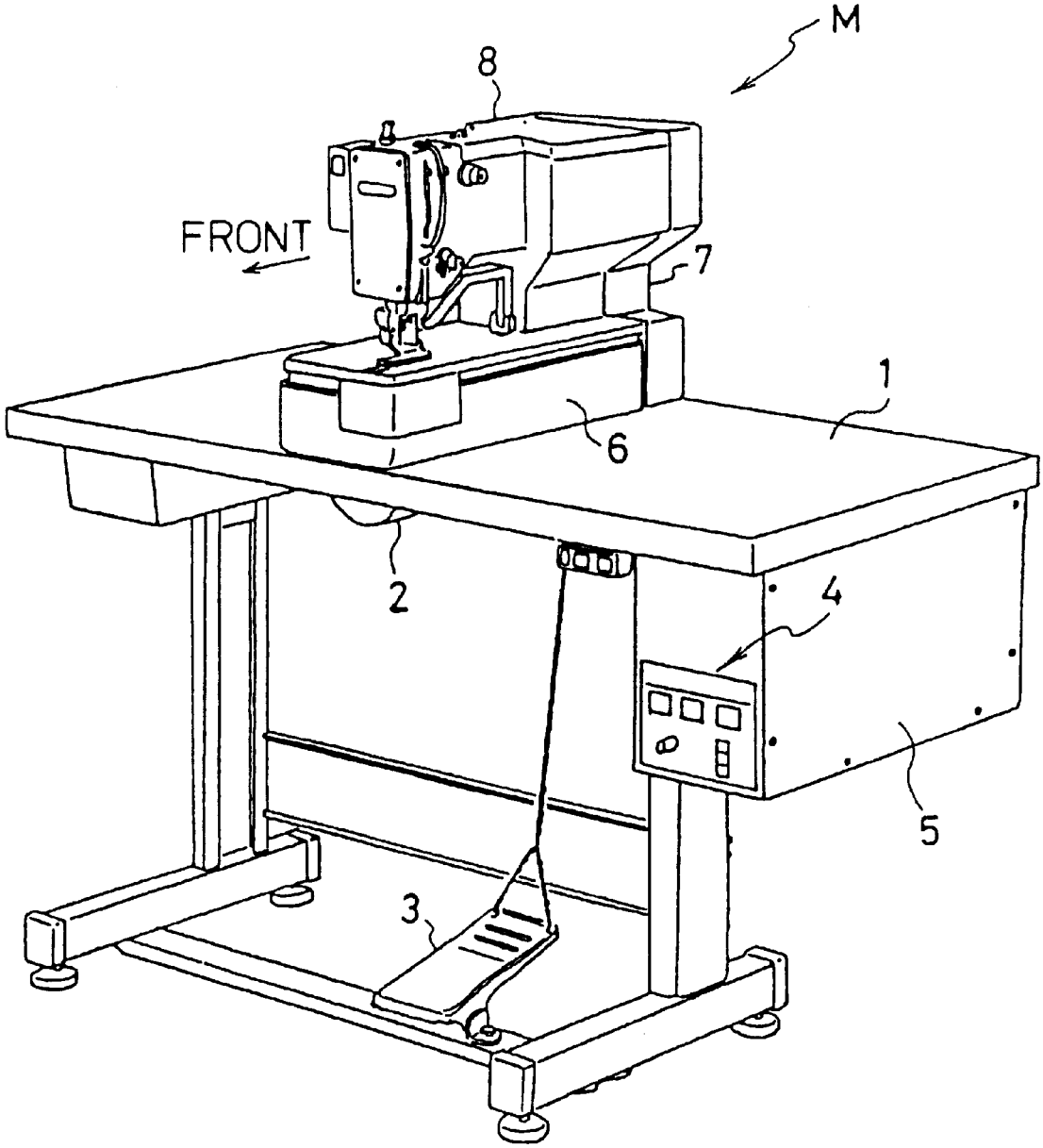
FIG. 1 is a perspective view of a buttonhole sewing machine to which the invention is applied.
Figure 6:
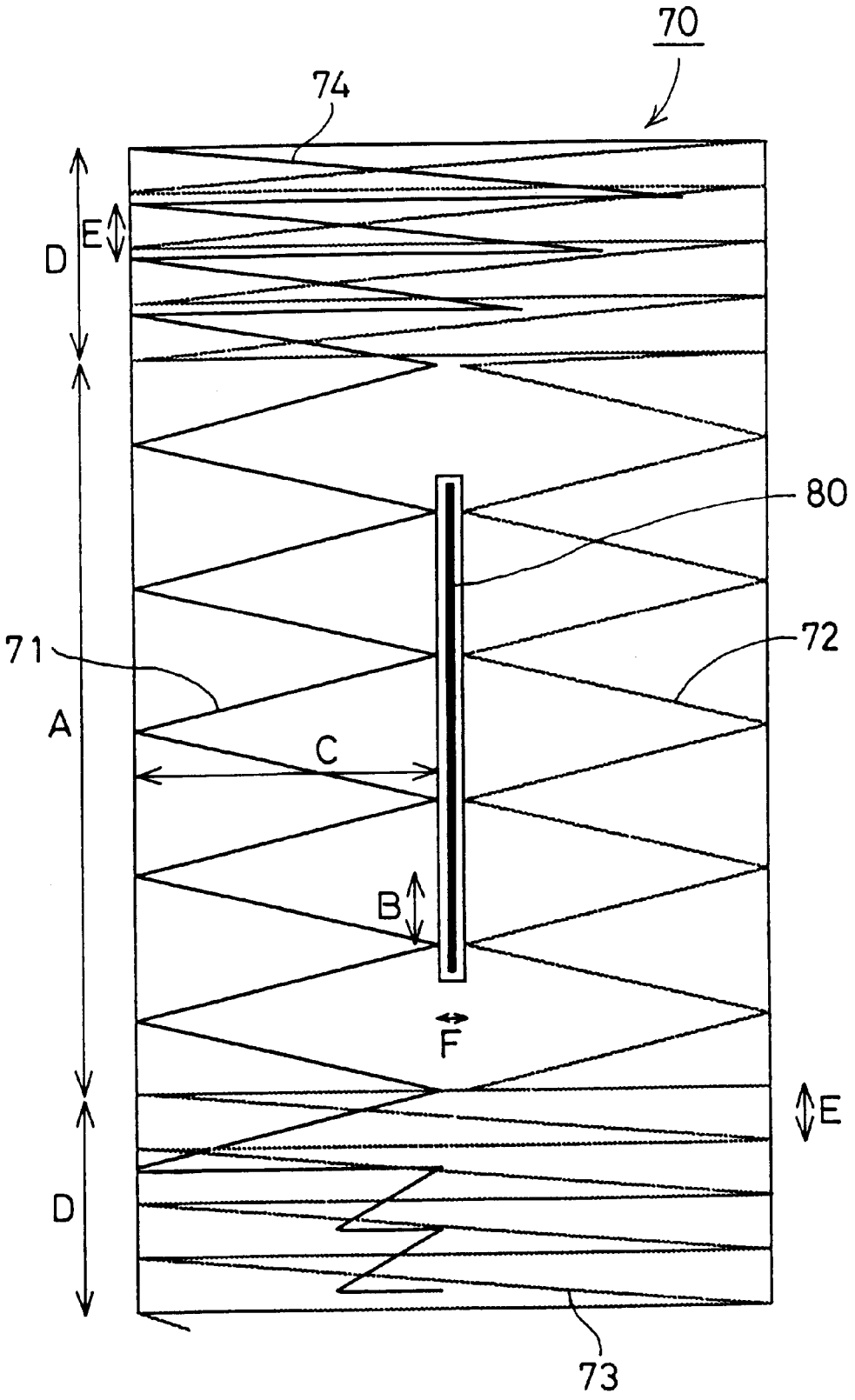
FIG. 6 shows a stitch formation for a buttonhole formed on the buttonhole sewing machine.

A preferred embodiment of the invention will be described in detail with reference to the accompanying drawings. FIG. 1 illustrates a buttonhole sewing machine M, viewed in perspective, to which the invention is applied. The sewing machine M sews a stitched buttonhole 70 (FIG. 6) on a work cloth (not shown), and cuts a slit between left and right zigzag stitch portions 71,72 of the stitched buttonhole 70, to form a buttonhole 80 (FIG. 6).

As shown in FIG. 1, the sewing machine M includes a machine table 1, a machine motor 2, a pedal 3 for starting and stopping the motor 2, an operation panel 4 through which various data is inputted to form the stitched buttonhole 70 and the buttonhole 80, a controller 5 to control each mechanism, which will be described later, a bed 6, a standard portion 7, and an arm 8.

Figure 2:
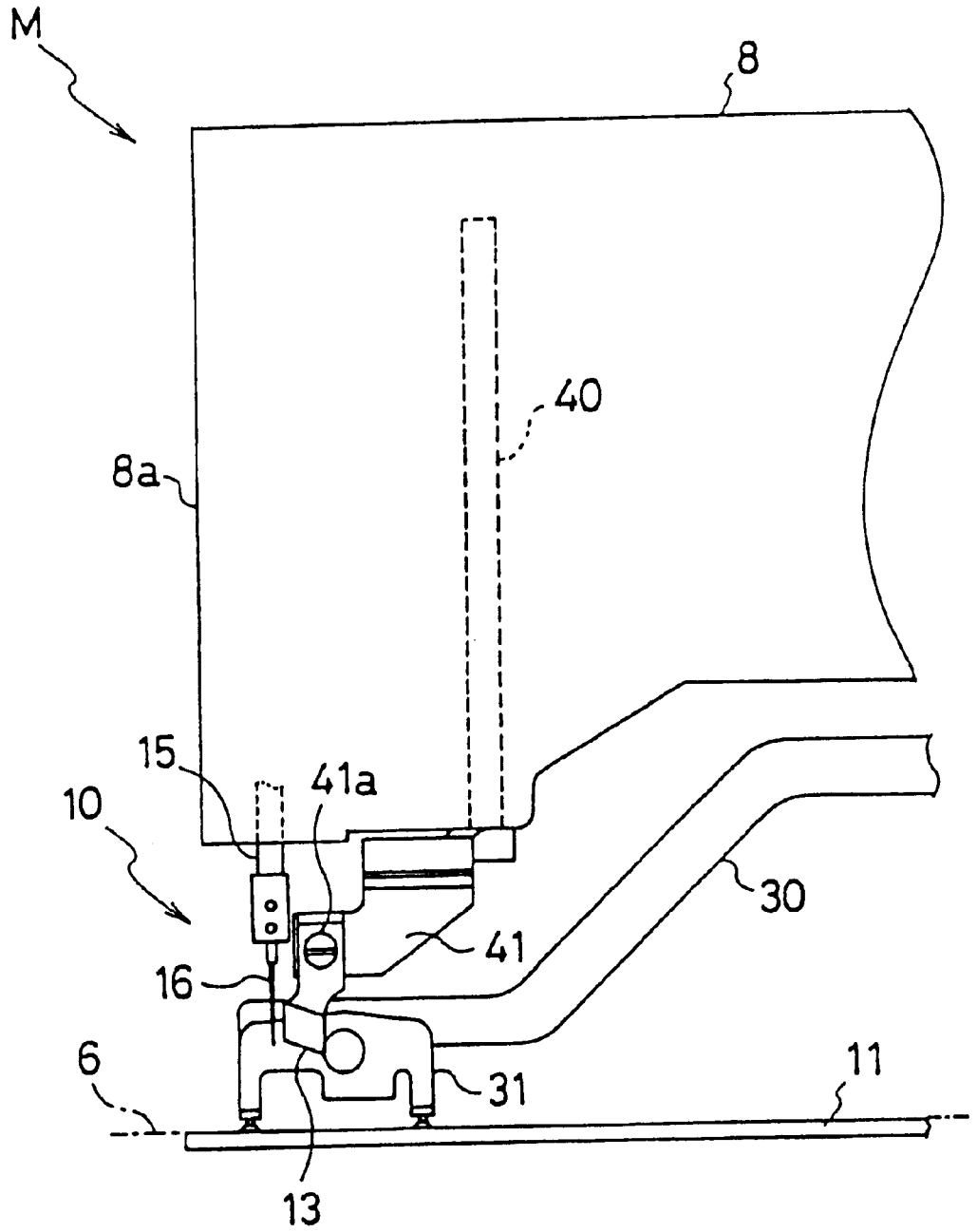
FIG. 2 is a side elevation of substantial parts of the buttonhole sewing mechanism viewed from the right.

FIG. 2 shows substantial parts of a sewing mechanism 10 where the stitched buttonhole 70 is formed. The sewing mechanism 10 is linked to a feed bracket 11 that feeds the work cloth in accordance with the stitch formation, a feed bracket driving mechanism 12 (FIG. 3) that moves the feed bracket 11 in a feeding direction of the work cloth, a cutter 13 that cuts the work cloth to make the buttonhole 80 between left and right zigzag stitch portions 71, 72, and a cutter driving mechanism 14 (FIG. 4) that moves the cutter 13 up and down.

As shown in FIG. 2, the sewing mechanism 10 comprises a needle bar 15 that is disposed in a head 8*a* of the arm 8, a needle 16 that is detachably fixed to the bottom of the needle bar 15, a needle bar driving mechanism 17 (FIG. 5) that allows the needle bar 15 to be moved vertically and oscillated laterally, and a rotating shuttle (not shown) that is provided in the bed 6 and cooperates with the needle 16 to create buttonhole stitches. The stitched buttonhole 70 is formed while the sewing mechanism 10 is driven, and accordingly the work cloth is fed via the feed bracket 11. As shown in FIG. 6, the stitched buttonhole 70 comprises the left zigzag stitch portion 71 and the right zigzag stitch portion 72. It further has a front bar-tack stitch portion 73 and a rear bar-tack stitch portion 74 at the front end and the back end respectively. During normal buttonhole sewing, a part of the front bar-tack stitch portion 73, the left zigzag stitch portion 71, the rear bar-tack stitch portion 74, the right zigzag stitch portion 72, and the rest of the front bar-tack stitch portion 73 are made in order. Lengths indicated with a letter, such as A and B in FIG. 6, are data to be set on the operation panel 4. The setting method will be described later.

Figure 3:
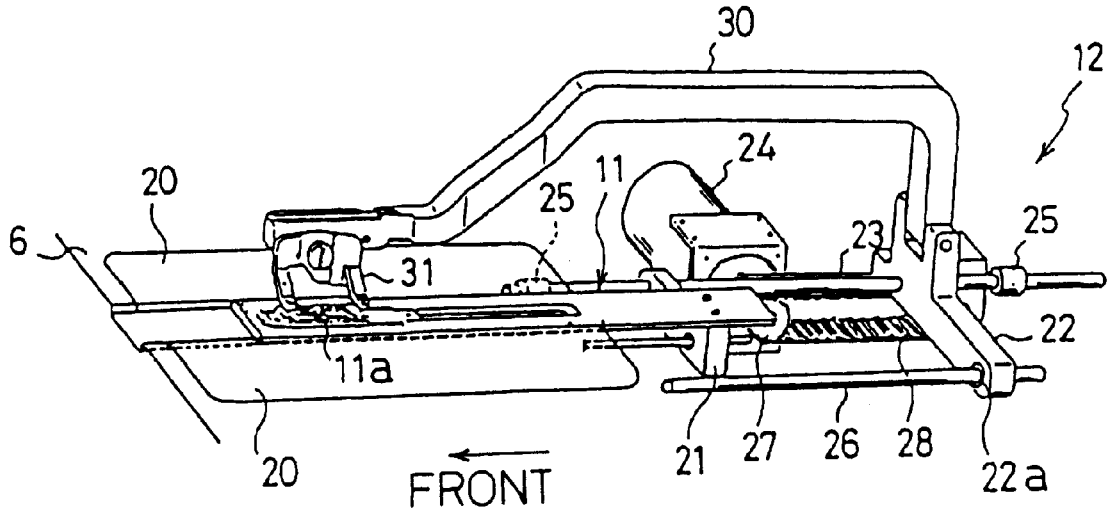
FIG. 3 is a perspective view of a feed bracket driving mechanism of the buttonhole sewing machine.

Next, the feed bracket 11 and the feed bracket driving mechanism 12 will be described. As shown in FIGS. 2 and 3, the feed bracket 11 is a long plate extending from the front toward the rear of the sewing machine, having a long slit 11*a* at the front end, in which the stitched buttonhole 70 and the buttonhole 80 are created. On the top of the bed 6, a pair of guide plates 20 are embedded to support the feed bracket 11 so that it can move back and forth.

The feed bracket driving mechanism 12 comprises a movable member 21 fixed to the back end of the bottom of the feed bracket 11, a movable member 22 linked to the movable member 21 with a fixed interval via a long connecting rod 23, and a stepping motor 24 that drives the movable member 22 to move back and forth.

The connecting rod 23 passes through the left holes (which are on the rear side as illustrated in FIG. 3) of the movable members 21,22. The connecting rod 23 is supported at a machine frame so as to move back and forth via a pair of bearings 25 on the outside of the movable members 21,22. A long rod 26 is disposed on the right, as one faces the sewing machine, of the connecting rod 23. The rod 26 passes through the right hole of the movable member 22, and is supported via a bearing 22*a* so as to move back and forth.

A driving pulley 27 is fixed to an output shaft of the stepping motor 24. On the rear of the driving pulley 27, a driven pulley (not shown) is fixedly disposed in the machine frame. The pulleys are connected via a loop belt 28. The movable member 22 is fixed to a part of the belt 28. When the stepping motor 24 runs, the feed bracket 11 is moved back and forth along with the movable members 21,22.

A cloth presser 31 is attached to a presser arm 30. The presser arm 30 is pivotally linked to the movable member 22. The cloth presser 31 is designed so that its force is applied downward by an urging member, not shown, via the presser arm 30. Thus, the cloth presser 31 fixedly presses the work cloth down on the feed bracket 11. The cutter 13 is attached to a cutter holder 41 using a screw 41*a*. The cutter holder 41 is attached to a shaft 40 that is moved up and down by the cutter driving mechanism 14, which will be described below.

Figure 4:
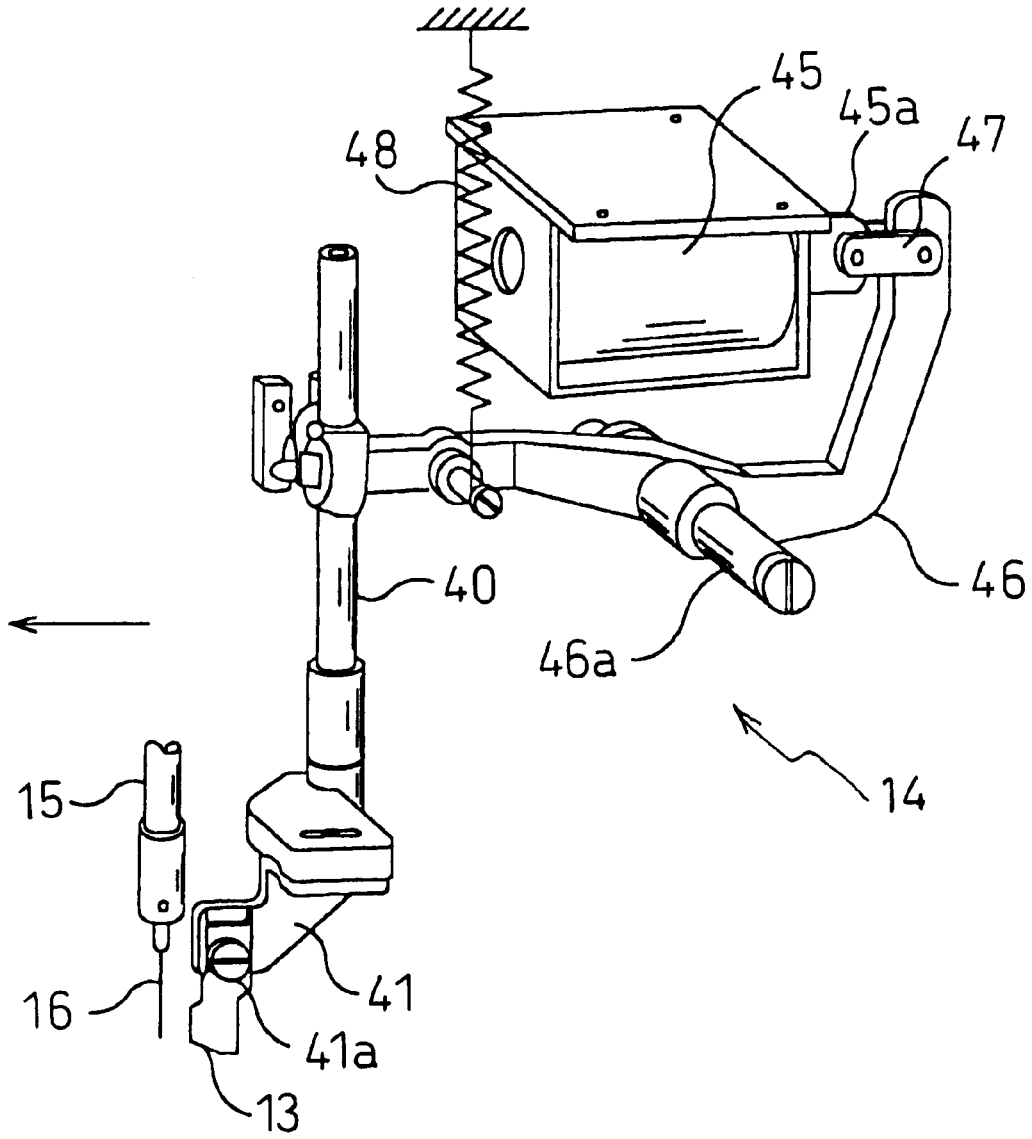
FIG. 4 is a perspective view of a cutter driving mechanism of the buttonhole sewing machine.

FIG. 4 is a perspective view showing a structure of the cutter driving mechanism 14. The cutter 13 is attached to the shaft 40 slightly behind the needle 16. The shaft 40 is linked to a plunger 45*a* of a solenoid 45 for driving the cutter 13 via associated parts, such as a cutter operating arm 46. The cutter operating arm 46 is bent upward, like in an L shape, at the rear, and oscillatably supported to the machine frame at the center via a pin 46*a*. The front end of the cutter operating arm 46 is connected to the shaft 40, and the back end of the arm 46 is linked to the plunger 45*a* projecting backward from the solenoid 45, via a link 47. The front end of the arm 46 is pulled upward by a spring 48.

Thus, as the plunger 45*a* of the solenoid 45 is protruded and retracted, the motion is transmitted to the shaft 40, causing the cutter 13 to move up and down. The solenoid 45 is a bidirectional solenoid that can move the plunger 45*a* toward both a protrusion direction and a retraction direction according to the status of whether the solenoid 45 is energized. Therefore, the spring 48 should have sufficient strength to compensate for the weight of the shaft 40 through the cutter 13. However, it is possible to omit the spring 48.

Figure 5:
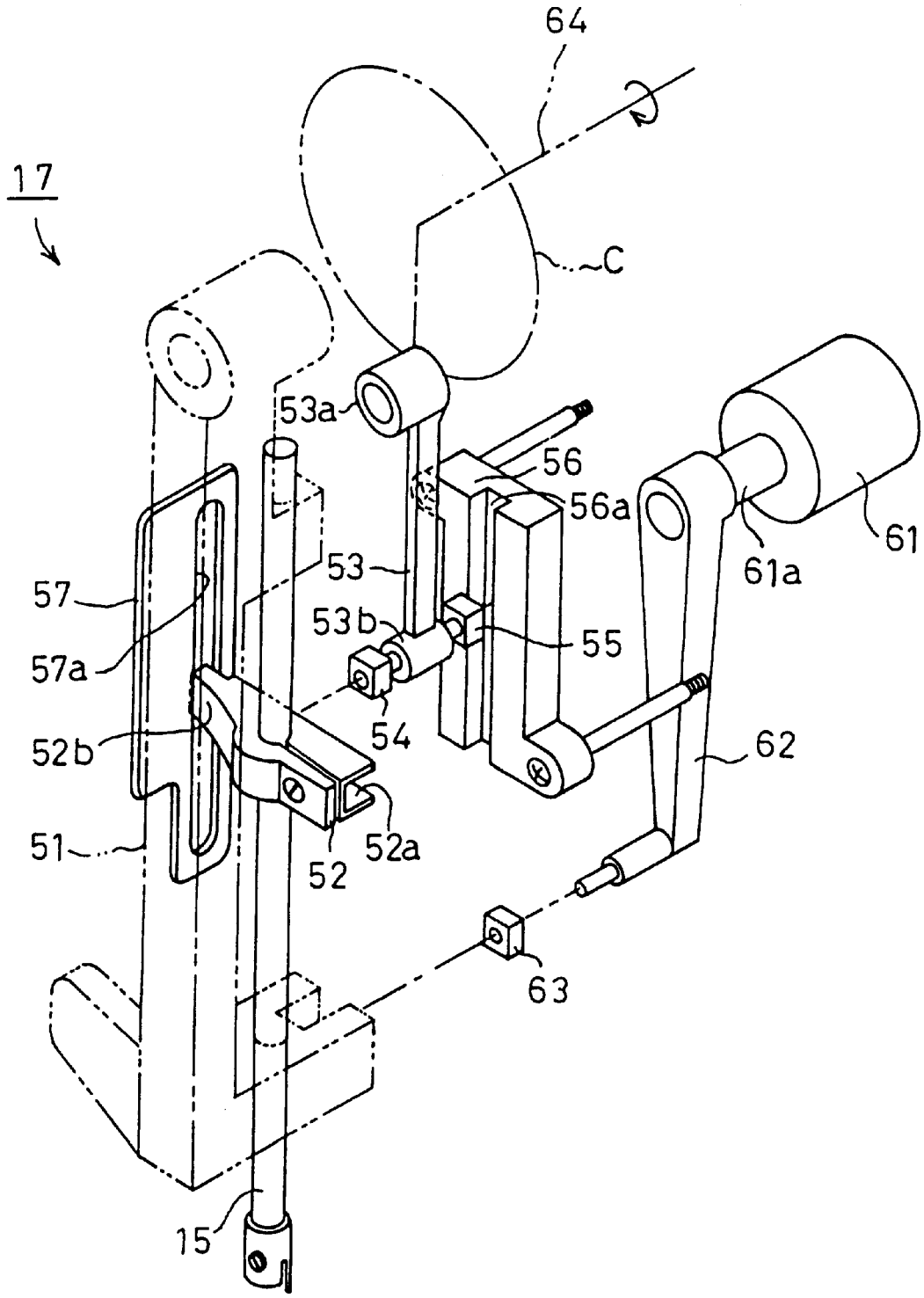
FIG. 5 is a perspective view of a needle bar driving mechanism of the buttonhole sewing machine.

FIG. 5 shows a structure of the needle bar driving mechanism 17 in a perspective view. In the needle bar driving mechanism 17, the needle bar 15 is slidably attached to a needle bar bracket 51 which is provided in the arm 8. A needle bar clamp 52 is secured to the needle bar 15 at a predetermined position.

A needle bar connecting rod 53 has two ends 53*a*,53*b*. One end 53*a* moves along a circle C in a vertical plane and the other end 53*b* is connected to the needle bar clamp 52 via a sliding block 54. A guide groove 52*a* is formed on the needle bar clamp 52 and engaged with the sliding block 54 so that it can move freely rightward and leftward. The end 53*b* of the needle bar connecting rod 53 has another sliding block 55 on the other side. The sliding block 55 is engaged with a vertical groove 56*a* of a guide bracket 56. The engagement allows the end 53*b* to move vertically only. Still, a planate needle bar guide 57 is secured to the needle bar bracket 51. The needle bar guide 57 has a slit 57*a* extending along the needle bar 15. A protrusion 52*b* of the needle bar clamp 52 is engaged in the slit 57*a*. The bottom of the needle bar bracket 51 is connected to a rocking lever 62 moving along with an output shaft 61*a* of a stepping motor 61 via a sliding block 63.

In the needle bar driving mechanism 17 as arranged above, when an upper shaft 64 is rotated by the machine motor 2, a force is applied to the needle bar connecting rod 53. The force is transmitted to the needle bar 15 via the sliding block 54, causing the needle bar 15 to be moved vertically. When the stepping motor 61 runs, a force is applied to the rocking lever 62. The force is transmitted to the needle bar bracket 51 via the sliding block 63, allowing the needle bar 15 to be moved laterally. The vertical and lateral motions of the needle bars 15 enable the formation of the stitched buttonhole 70. In addition, a width of each part of the stitched buttonhole 70 can be changed by controlling the rotation angle of the stepping motor 61, which will be described later.

Figure 7:
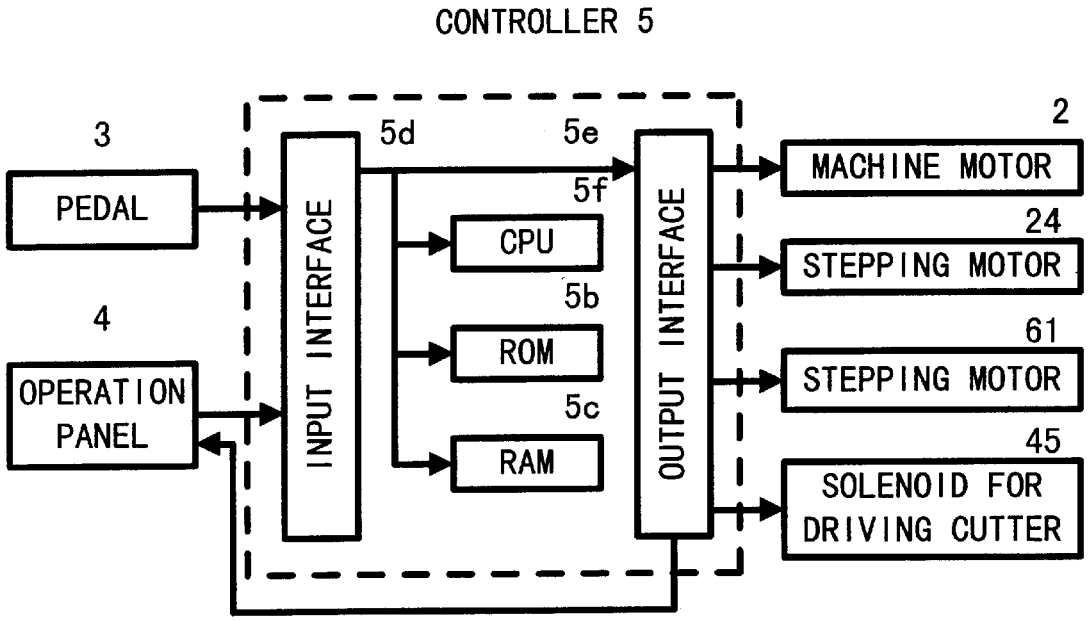
FIG. 7 shows a structure of a control system of the buttonhole sewing machine.

The structure of the control system of the sewing machine M will now be described. As shown in FIG. 7, the controller 5 comprises a CPU 5*a*, a ROM 5*b*, a RAM 5*c*, an input interface 5*d*, and an output interface 5*e*, all connected via a bus 5*f*. The input interface 5*d* receives input signals from the pedal 3 and the operation panel 4. The output interface 5*e* outputs driving signals to the machine motor 2, the stepping motor 24, the stepping motor 61, and the solenoid 45 via a drive circuit, not shown. It also outputs a control signal for displaying the status of the sewing machine to the operation panel 4.

Figure 8:
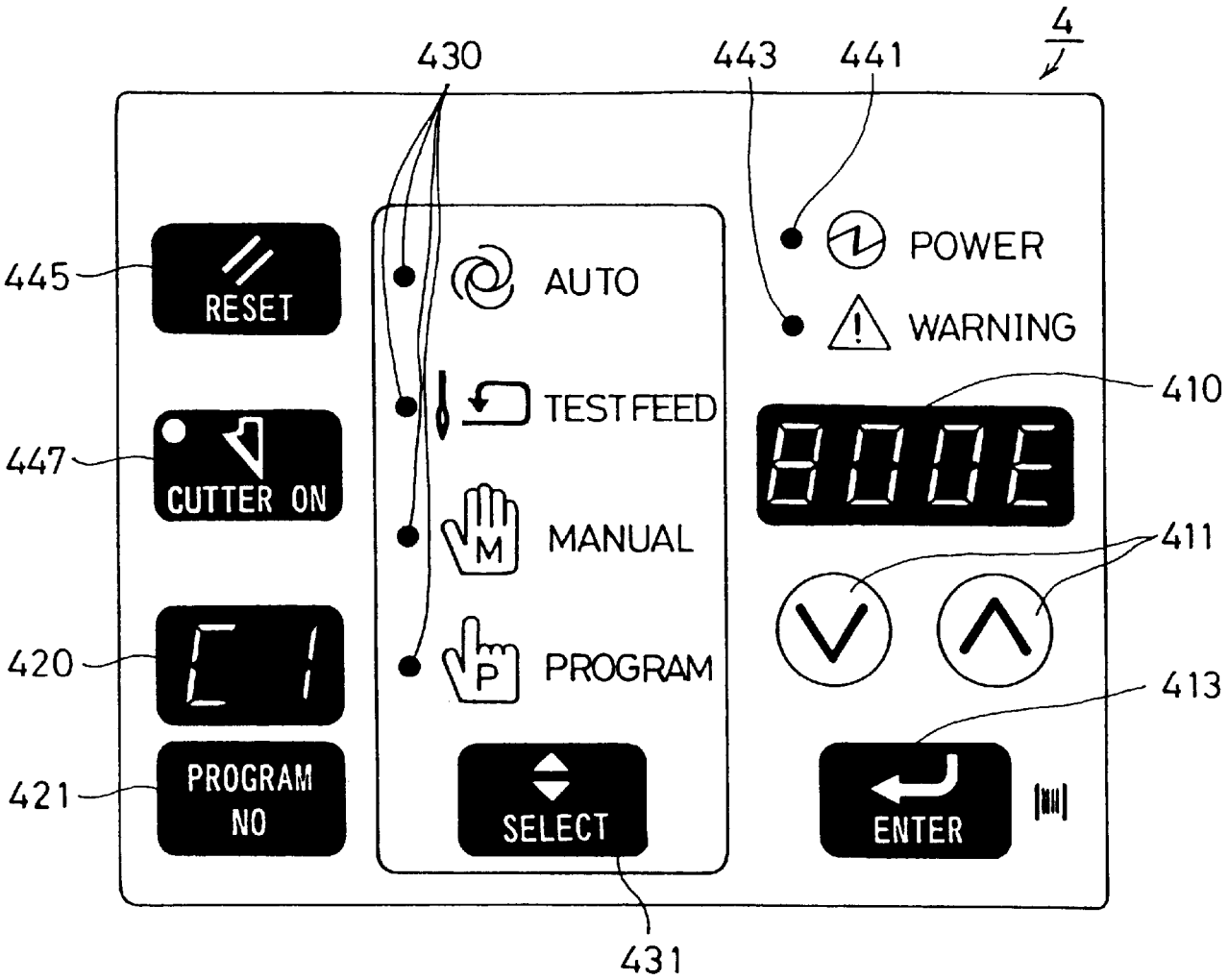
FIG. 8 is an example of an operation panel used in the buttonhole sewing machine.
Figure 9A:
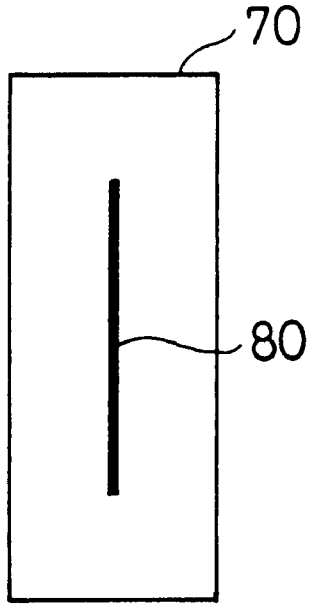
FIGS. 9(A)–9(D) show examples of stitched buttonhole shapes modified on the buttonhole sewing machine.
Figure 9B:
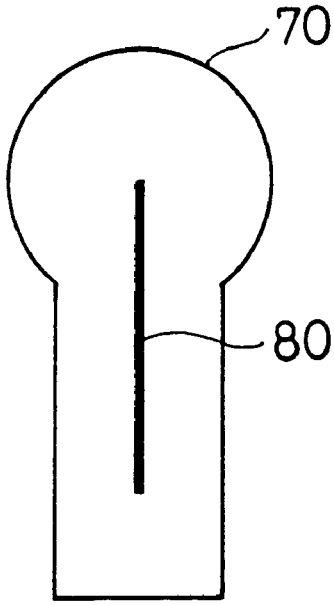
Figure 9C:
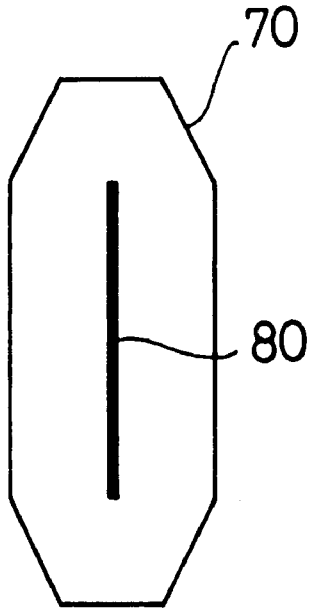
Figure 9D:
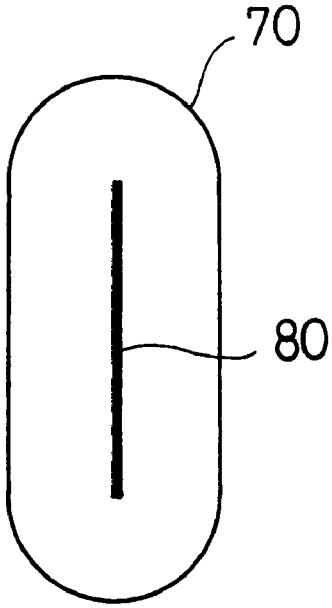

A structure of the operation panel 4 and its use will be described with reference to FIG. 8. The operation panel 4 includes a seven-segment display 410 capable of showing a four-digit number, a seven-segment display 420 capable of showing a two-digit number, and a plurality of LEDs 430 indicating the control mode currently set in the sewing machine M.

A number displayed on the display 410 can be changed using the up- and down-arrow keys 411 and determined using the ENTER key 413. A number displayed on the display 420 can be changed cyclically using the PROGRAM NO. key 421. The sewing machine M has the following modes: auto mode (AUTO) where regular sewing is performed based on programs described later; test feed mode (TEST FEED) where the needle points are checked without dropping the needle 16 (actual sewing is not performed); manual mode (MANUAL) where an operator turns a pulley, not shown, by hand to perform manual sewing; and program mode (PROGRAM) where settings concerning programs described later are made. These modes are alternately switched using the SELECT key 431. According to the switching of modes, a LED 430 corresponding to the mode currently set is lit.

The operation panel 4 further includes an LED 441 indicating the power is turned on, an LED 443 warning an error has happened, a RESET key 445 resetting the status of the sewing machine M after measures to connect the error have been taken, and a CUTTER ON key 447 activating the cutter 13 regardless of the program setting.

When a mode, except for the program mode is set, the controller 5 displays a message on the display 410 and a program number as currently set on the display 420. As a type of stitched buttonhole 70, the sewing machine M provides for sewing various shapes of stitched buttonholes, as shown in FIGS. 6 and 9, such as a rectangular stitched buttonhole (FIGS. 6 and 9(A)), an eyelet stitched buttonhole whose one end bulges circularly (FIG. 9(B)), a boat-form stitched buttonhole with tapered ends (FIG. 9(C)), and a round-end or oval stitched buttonhole (FIG. 9(D)). The stitched buttonhole shapes are assigned to program numbers. The following description uses the case where the rectangular stitched buttonhole 70 is selected and zigzag stitch portions 71,72 are not sewn doubly, as an example.

When the operator uses the PROGRAM NO key 421 to display a corresponding program number on the display 420, and sets the program mode using the SELECT key 431, the display 420 shows a parameter number corresponding to the selected program. The parameters for the programs are divided into a first parameter group including parameter numbers 00 to 49 as shown in Table 1, and a second parameter group including parameter numbers 50 to 99 as shown in Table 2. When the operator uses the PROGRAM NO key 421 in the program mode, a desired parameter number appears on the display 420, and the parameter is set. For example, when parameter number 00 appears on the display 420 of a sewing machine M just shipped, the display 410 shows the default value 3,500 (stitches per minute, spm)of a rotation speed. This value can be changed using the up and down-arrow keys 411 using 100 spm as the minimum unit, within the range of 2000 spm to 4000 spm.

TABLE 1

| No. | Item | Setting value | Minimum unit | Default |
|---|---|---|---|---|
| 00 | Rotation speed | 2000–4000 spm | 100 | 3500 |
| 01 | Zigzag stitch length | 6.4–42 mm | 0.1 | 10 |
| 02 | Zigzag pitch | 0.20–2.00 mm | 0.05 | 1.00 |
| 03 | Zigzag width | 0.5–3 mm | 0.1 | 2 |
| 04 | Bar-tack length | 1–10 mm | 0.1 | 2 |
| 05 | Bar-tack pitch | 0.20–1.00 mm | 0.05 | 0.50 |
| 06 | Cutter space | −0.3–+3.0 mm | 0.1 | 0 |
| 07 | Cutter X position correction | −0.5–+0.5 mm | 0.1 | 0 |
| 08 | Cutter Y position correction | −1.0–0.0 mm | 0.1 | 0 |
| 09 | Zigzag width ratio (at left) | 0.1–0.9 | 0.1 | 0.5 |
| 10 | No. of start backtack stitches | 2–6 stitches | 2 | 4 |
| 11 | No. of end backtack stitches | 1–6 stitches | 1 | 4 |
| 12 | Start backtack stitch width | 0.5–3.0 mm | 0.1 | 0.5 |
| 13 | Start backtack pitch | 0.20–0.80 mm | 0.05 | 0.40 |
| 14 | Front bar-tack width correction | −2.0–+2.0 mm | 0.1 | 0 |
| 15 | Rear bar-tack width correction | −2.0–+2.0 mm | 0.1 | 0 |
| 16 | Front bar-tack length correction | −5.0–+5.0 mm | 0.1 | 0 |
| 17 | Rear bar-tack length correction | −5.0–+5.0 mm | 0.1 | 0 |
| 18 | Stitch type (thread tension control) | 0: Whip<br>1: Pearl | | 1 |
| 19 | Multi-working cutter | ON: Multiple<br>OFF: Single | | OFF |
| 20 | Double sewing | 0: No double sewing<br>1: Type A<br>2: Type B | | 0 |

TABLE 1-continued

| No. | Item | Setting value | Minimum unit | Default |
|---|---|---|---|---|
| 21–49 | Unused | | | 0 |

TABLE 2

| No. | Item | Setting value | Minimum unit | Default |
|---|---|---|---|---|
| 50 | Cutter size | 10–50 mm according to specs. | 1 | 10 |
| 51 | No. of stitches at slow start | 0–4 stitches | 1 | 1 |
| 52 | Slow start speed | 500–1500 spm | 100 | 1.200 |
| 53 | Sewing speed correction at bar-tack | −900–0 spm | 100 | 0 |
| 54 | Cutter ON time | 20–40 ms | 10 | 20 |
| 55 | Delay time for start (for single pedal) | 50–200 ms | 10 | 50 |
| 56 | Rear bar-tack tension release timing | −4–1 stitches | 1 | 0 |
| 57 | Rear bar-tack tension applying timing | −4–1 stitches | 1 | 0 |
| 58 | Front bar-tack tension release timing | −4–0 stitches | 1 | 0 |
| 59 | Sewing start tension applying timing | 0–5 stitches | 1 | 0 |
| 60 | Sewing end tension applying timing | −2–1 stitches | 1 | 0 |
| 61 | Bobbin thread cutting speed | −4–4 | 1 | 0 |
| 62 | Presser foot lifting speed | −4–4 | 1 | 0 |
| 63 | Presser foot height at treadle back position | 1–13 mm | 1 | 13 |
| 64 | Presser foot height at neutral position | 1–13 mm | 1 | 10 |
| 65 | Soft press height | OFF, 1–13 mm | 1 | OFF |
| 66 | Delay time for continuos sewing | OFF, 0–1000 spm | 100 | OFF |
| 67 | Home position return cycle | OFF, 1–10 | 1 | 1 |
| 68 | Displayed item in AUTO mode | Pro: production counter<br>Bob: bobbin thread counter | | pro |
| 69 | Feed timing | 0–10 | 1 | 0 |
| 70 | Max. cycle program number | 0–9 | 1 | 1 |
| 71–99 | Unused | | | 0 |

If the PROGRAM NO key 421 only is operated, the setting for the first parameter group as shown in Table 1 is available. To set a parameter of the second parameter group (when a parameter number of 50 to 99 appears on the display 420), as shown in Table 2, the ENTER key 413 and the PROGRAM NO key 421 are operated at the same time. The first parameter group is available only for a selected program and can be changed often. The second parameter group is common to all programs, and is rarely changed.

Of the parameters in Table 1, no. 01 "zigzag stitch length" represents the length for the zigzag stitch portions 71,72 as indicated by A in FIG. 6, no. 02 "zigzag pitch" represents the pitch for the zigzag stitch portions 71,72 as indicated by B, no. 03 "zigzag width" represents the width for each of the zigzag stitch portions 71,72 as indicated by C, no. 04 "bar-tack length" represents the length for bar-tack stitch portions 73,74 as indicated by D, no. 05 "bar-tack pitch" represents the pitch for bar-tack stitch portions 73,74 as indicated by E, no. 06 "cutter space" represents the distance between the zigzag stitch portions 71,72 for opening the buttonhole 80 therein as indicated with F in FIG. 6. The following is a description of the steps that the controller 5 performs based on the parameters set in this manner.

Figure 10:
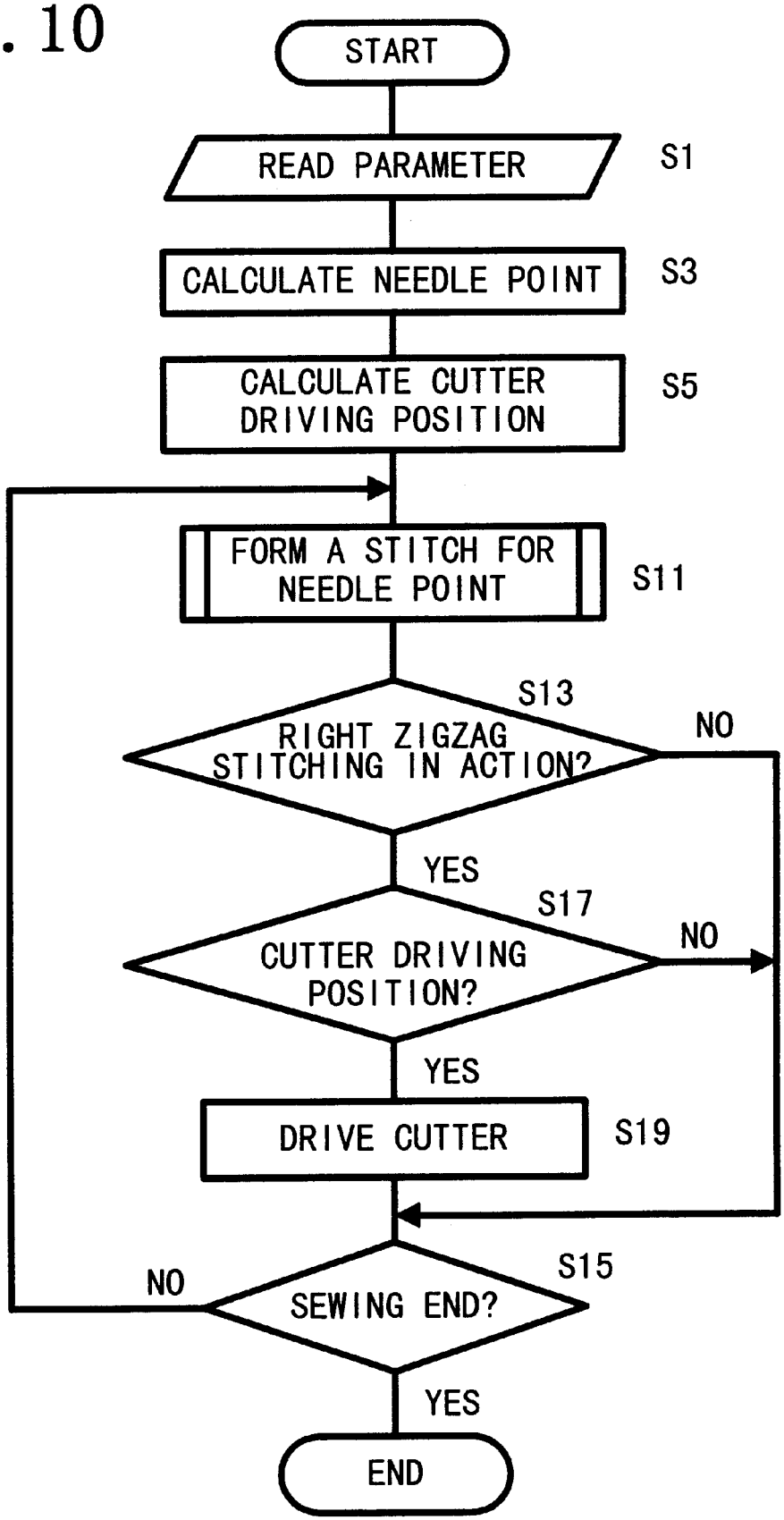
FIG. 10 is a flowchart showing a sequence of steps performed in the control system.

When the operator treadles the pedal 3 after setting each parameter, the controller 5 executes the steps of the flowchart as shown in FIG. 10. The controller 5, at S1 (S stands for a step), first reads each set parameter to a predetermined place in the RAM 5*c* and calculates the needle points corresponding to each parameter at S3. At S5, the controller 5 calculates the driving position of the cutter 13 corresponding to the parameters. In the sewing machine M, to sew a stitched buttonhole, a part of the front bar-tack stitch portion 73, the left zigzag stitch portion 71, the rear bar-tack stitch portion 74, the right zigzag stitch portion 72, and the rest of the front bar-tack stitch portion 73 are made in order. Therefore, the driving position of the cutter 13 is fixed while sewing the right zigzag stitch portion 72 is sewn or just after it is completed.

At S11, a stitch for each needle point calculated at S3 is made. More specifically, the feed bracket 11 and the needle bar bracket 51 are driven in accordance with the number of stitches counted at the counter, and the needle bar 15 is moved vertically at a desired needle point. After one stitch is made, the procedure is shifted to S13. At S13, the controller 5 determines whether the right zigzag stitch portion 72 is being formed. Since a stitched buttonhole is sewn starting from a part of front bar-tack stitch portion 73, the controller 5 shifts to S15 upon the start of buttonhole sewing. At S15, the controller 5 determines whether buttonhole sewing is completed. At first, the controller 5 determines NO at S15, and returns to S11. As the steps S11 to S15 are repeated buttonhole sewing is performed. When sewing goes into the right zigzag stitching (S13: Yes), the controller 5 goes to S17.

At S17, the controller 5 determines whether buttonhole sewing at the cutter driving position, calculated at S15, is completed or not. When sewing is not approaching the cutter driving position (S17: No), the controller 5 goes to S15 to continue sewing for the stitched buttonhole 70. When sewing is completed to the cutter driving position (S17: Yes), the cutter 13 is operated to form the buttonhole 80 at S19, and then the controller 5 goes to S15. When sewing of the stitched buttonhole 70 is completed, the controller 5 determines Yes at S15 and the operation is finished. In this manner, the stitched buttonhole 70 corresponding to each parameter set on the operation panel 4 can be formed.

Figure 11:
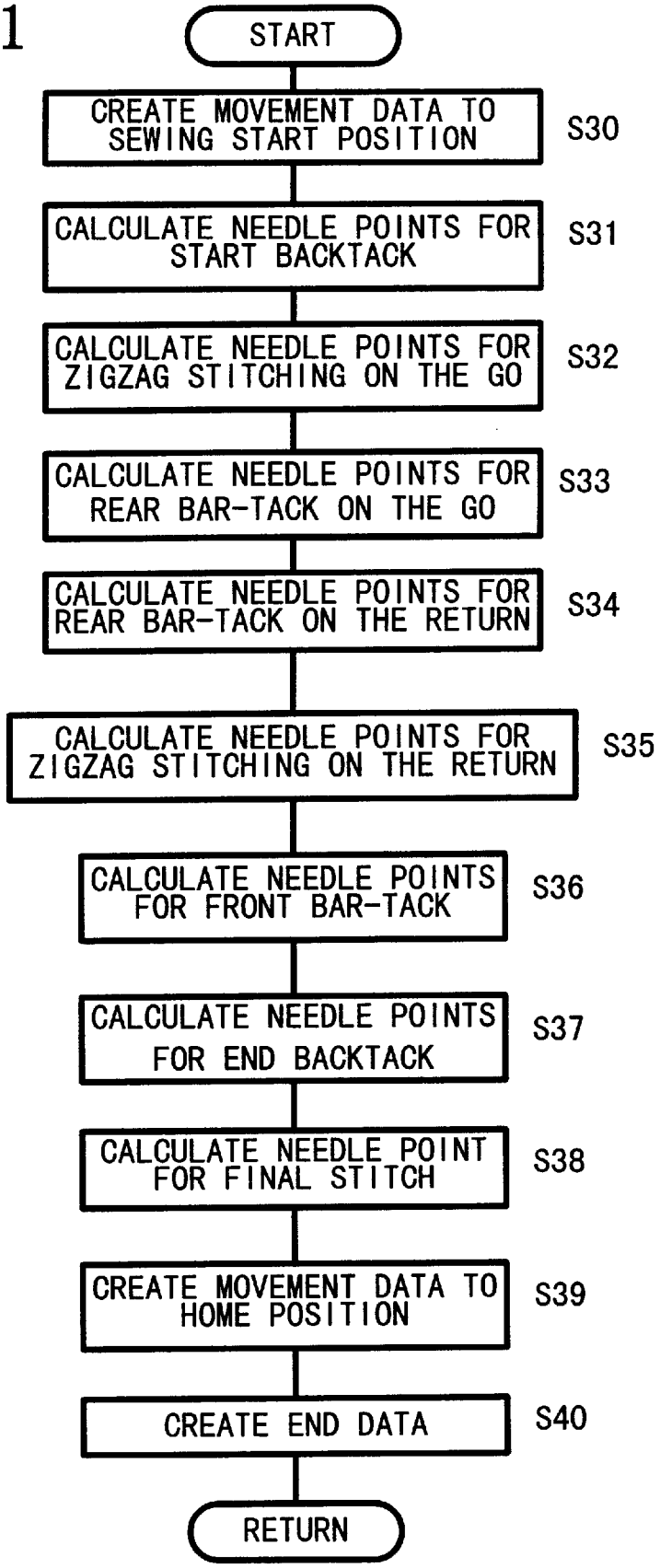
FIG. 11 is a flowchart of detailed steps developed at step S3 of FIG. 10.
Figure 12:
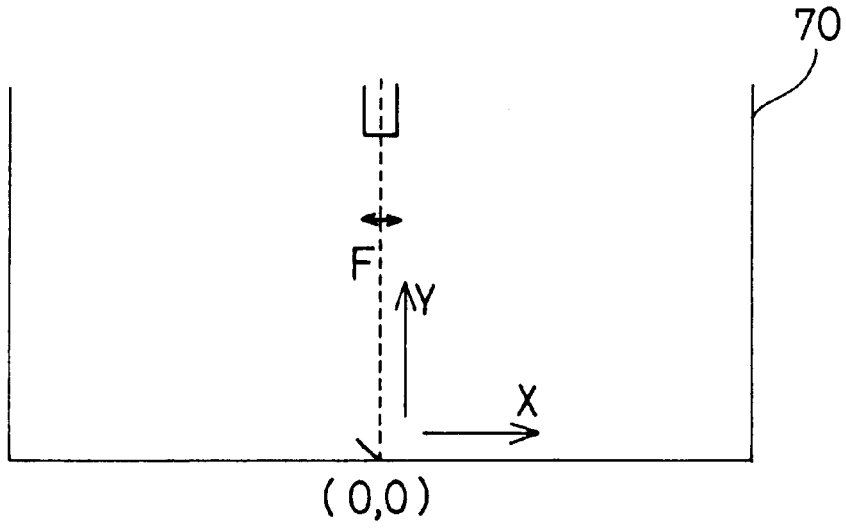
FIG. 12 shows a travelling route of a needle just before the actual sewing.

The step for calculating the needle point performed at S3 will now be described in detail with reference to FIGS. 11 to 20. FIG. 11 shows a flowchart of steps developed at S3 in detail. When the controller 5 goes to S3, it first creates movement data where feeding without sewing is carried out to the sewing start position (S30). As shown in FIG. 12, in the controller 5, an orthogonal coordinate system is assumed such that there is a home position (0, 0) in the middle of the front end of the stitched buttonhole 70 and the X-axis represents the zigzag direction of the needle and the Y-axis represents the material feeding direction. At S30, the coordinates for the sewing start position are calculated using the following formula based on setting value F for "cutter space (06)" (a two-digit number in a bracket represents a parameter number hereinafter):

$$(X, Y)=(-F/2, 0.2)$$

As a result, the travelling route of the needle 16 just before sewing is as indicated by the solid line shown in FIG. 12. At S31, the needle points for the start of backtack stitches (which are sewn at the start of sewing) are calculated. For example, when the number of start backtack stitches (10) is set to 4, the needle points from the first stitch to the fifth stitch are calculated using the following formulas:

$$\text{First stitch}=(-F/2-J1, 0.2)$$

$$\text{Second stitch}=(-F/2, 0.2+M)$$

$$\text{Third stitch}=(-F/2-J1, 0.2+M)$$

$$\text{Fourth stitch}=(-F/2, 0.2+2M)$$

$$\text{Fifth stitch}=(-F/2-CL1+0.2, 0.2+2M)$$

Wherein:

J1=start backtack stitch width (12)

M=start backtack pitch (13)

CL1=2×(zigzag width (03)+front bar-tack width correction (14))× zigzag width ratio (09)

In short, while sewing for the number of stitches set in "No. of start backtack stitches (10)" is performed, the zigzag width of the needle 16 is regarded as J1. After sewing that, the zigzag width of the needle 16 becomes 0.2 mm smaller than CL1, that is, the front bar-tack width to the left added the width of the zigzag stitch portions 71,72 to the front bar-tack width correction. The number of remaining stitches to be sewn in the front bar-tack length except for start bar-tack stitch N1 is represented with the following formula, and the above zigzag width while sewing the number of stitches N1 becomes CL1−0.2.

$$N1\approx 2\times(D1-I1\times DM/2-0.2)/B \quad (1)$$

Wherein:

I1=no. of start backtack stitches (10)

D1=bar-tack length (04)+front bar-tack length correction (16)

B=zigzag pitch (02)

Therefore, the actual pitch P1 at start backtack stitching is represented with the following formula:

$$P1=(D1-I1\times M/2-0.2)/(N1/2)$$

In the start backtack stitching, the sixth stitch or later are determined as follows:

$$\text{Sixth stitch}=(-F/2, 0.2+2M+P1)$$

$$\text{Seventh stitch}=(-F/2-CL1+0.2, 0.2+2M+P1)$$

$$I1+N1\text{th stitch}=(-F/2, D1)$$

Figure 13:
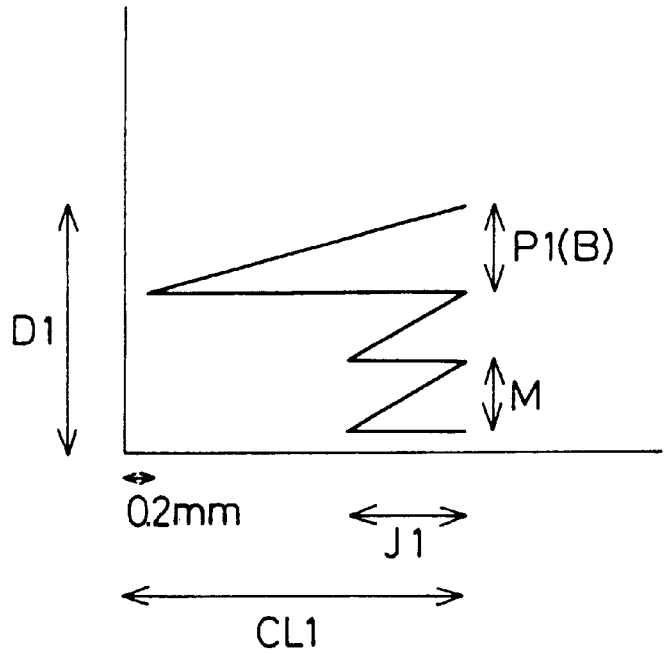
FIG. 13 shows a travelling route of the needle at the start of sewing.
Figure 14A:
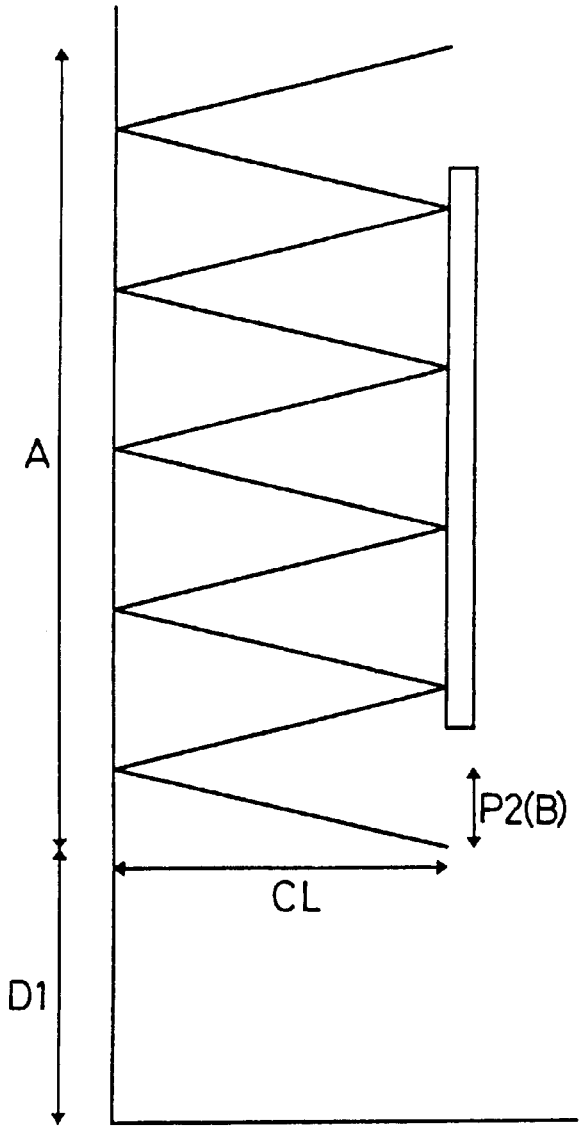
FIGS. 14(A) and 14(B) show a travelling route of the needle in forming a zigzag stitch pattern on the go.
Figure 14B:
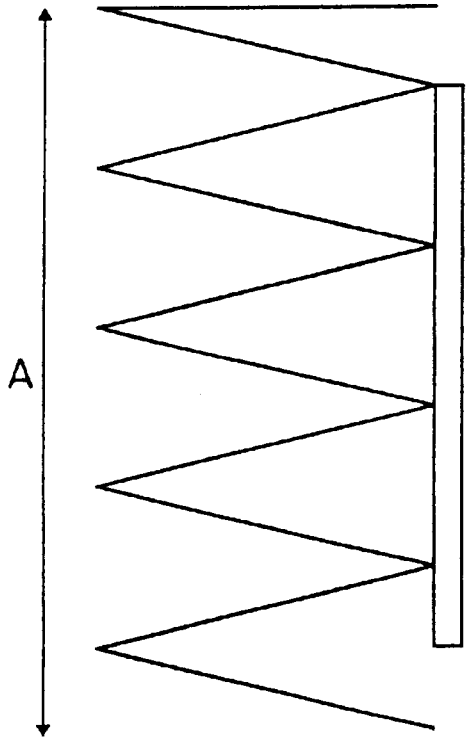

Accordingly, the travelling route of the needle 16 at start backtack stitching is as indicated with a solid line in FIG. 13. Because the number of stitches N1 for start backtack stitching is calculated using the formula (1), the parameter requires a limiting factor of $D1>I1\times M/2-0.2$.

At S32, the needle points of the left zigzag stitch portion 71 (hereinafter referred to as the zigzag stitch on the go) are calculated. The number of stitches for the zigzag stitch on the go N2 (zigzag stitch number N2) is represented with the following formula. It varies depending on whether it is even or odd.

$$N2 \approx 2 \times A/B$$

Wherein:

A is the set value of zigzag stitch length (01).

The needle points in this case are calculated as follows:

when the zigzag stitch number N2 is an even number, i.e., 10:

First stitch=(−F/2−CL, P2+D1)

Second stitch=(−F/2, 2×P2+D1)

Third stitch=(−F/2−CL, 3×P2+D1)

Fourth stitch=(−F/2, 4×P2+D1)

Fifth stitch=(−F/2−CL, 5×P2+D1)

Sixth stitch=(−F/2, 6×P2+D1)

Seventh stitch=(−F/2−CL, 7×P2+D1)

Eighth stitch=(−F/2, 8×P2+D1)

Ninth stitch=(−F/2−CL, 9×P2+D1)

Tenth stitch=(−F/2, 10×P2+D1)

when the zigzag stitch number N2 is an odd number, i.e., 9:

First stitch=(−F/2−CL, P2+D1)

Second stitch=(−F/2, 2×P2+D1)

Third stitch=(−F/2−CL, 3×P2+D1)

Fourth stitch=(−F/2, 4×P2+D1)

Fifth stitch=(−F/2−CL, 5×P2+D1)

Sixth stitch=(−F/2, 6×P2+D1)

Seventh stitch=(−F/2−CL, 7×P2+D1)

Eighth stitch=(−F/2, 8×P2+D1)

Ninth stitch=(−F/2−CL, 9×P2+D1)

Tenth stitch=(−F/2, 9×P2+D1)

Wherein:

$$P2=A/N2$$

$$CL=2\times\text{zigzag width (03)}\times\text{zigzag width ratio (09)} \quad (2)$$

Therefore, the former case is 10×P2=A and the latter is 9×P2=A. A+D1 is substituted for the Y coordinates at the tenth stitch in the former case and at the ninth and tenth stitches in the latter case. As a result, the travelling route of the needle 16 at the zigzag stitching on the go is as indicated with a solid line in FIG. 14(A) for the former case (even) and in FIG. 14(B) for the latter case (odd).

At S33, the needle points at the rear bar-tack stitch portion 74 sewn backward (rear bar-tack on the go) are calculated. The number of stitches at the rear bar-tack on the go N3 and its pitch P3 are represented as follows:

$$N3 \approx 2\times D2/E$$

$$P3=D2/(N3/2)$$

Wherein:

D2=bar-tack length (04)+rear bar-tack length correction (17)

E=bar-tack pitch (05)

Figure 15:
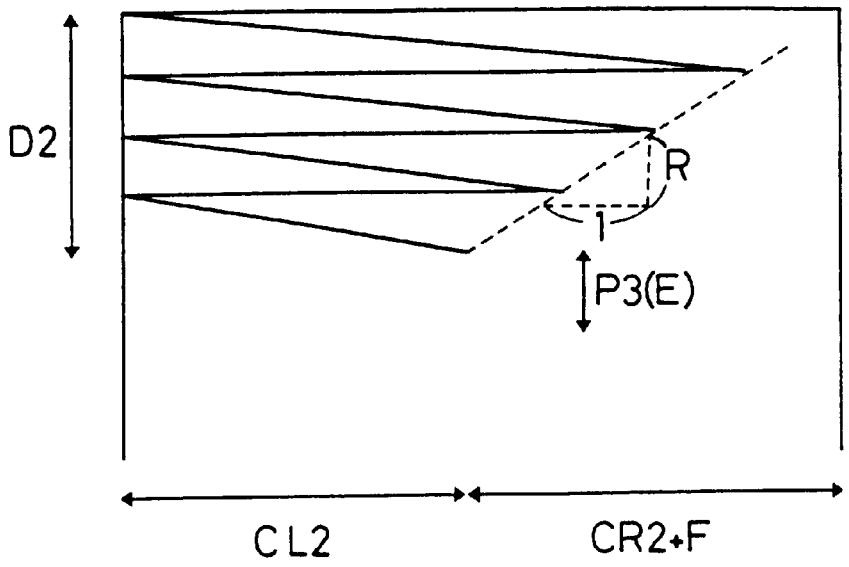
FIG. 15 shows a travelling route of the needle in forming a rear bar-tack stitch pattern on the go.

In case of N3=8, the needle points are represented with the following formulas, and the travelling route of the needle 16 is as indicated with a solid line of FIG. 15.

First stitch=(−F/2−CL2, A+D1+P3)

Second stitch=(−F/2+R×P, A+D1)+P3)

Third stitch=(−F/2−CL2, A+D1+2×P3)

Fourth stitch=(−F/2+R×2×P, A+D1+2×P3)

Fifth stitch=(−F/2−CL2, A+D1+3×P3)

Sixth stitch=(−F/2+R×3×P, A+D1+3×P3)

Seven stitch=(−F/2−CL2, A+D1+4×P3)

Eighth stitch=(−F/2+R×4×P, A+D+4×P3)

Wherein:

R=(CR2+F)/D2

CL2=2×(zigzag width (03)+rear bar-tack width correction (15))× zigzag width ratio (09).

In any case of the above formulas, a limiting factor of N3≧2 is required.

At S34, the needle points at the rear bar-tack stitch 74 sewn forward (the rear bar-tack on the return)are calculated. The number of stitches at the rear bar-tack on the return N4 and its pitch P4 are represented in a similar way to the rear bar-tack on the go, as follows:

$$N4 \approx 2\times D2/E$$

$$P4=D2/(N4/2)$$

At the rear bar-tack stitch portion 74 on the return, the shape of the pattern made from the needle points to be calculated varies depending on whether the zigzag stitch number N2 is even or odd. In case of N2=10 (even), for example, the needle points are represented with the following formulas and the travelling route of the needle 16 is as indicated with a solid line of FIG. 16(A).

First stitch=(−CL2−F/2, A+D1+D2+0.2−P4)

Second stitch=(CR2+F/2, A+D1+D2+0.2−P4)

Third stitch=(−CL2−F/2, A+D1+D2+0.2−2×P4)

Fourth stitch=(CR2+F/2, A+D1+D2+0.2−2×P4)

Fifth stitch=(−CL2−F/2, A+D1+D2+0.2−3×P4)

Sixth stitch=(CR2+F/2, A+D1+D2+0.2−3×P4)

Seventh stitch=(−CL2−F/2, A+D1+D2+0.2−4×P4)

Eighth stitch=(CR2+F/2, A+D1+D2+0.2−4×P4)

Ninth stitch=(F/2, A+D1)

Wherein:

CR2=2×(zigzag width (03)+rear bar-tack width correction (15))×((1−zigzag width ratio (09))

Figure 16A:
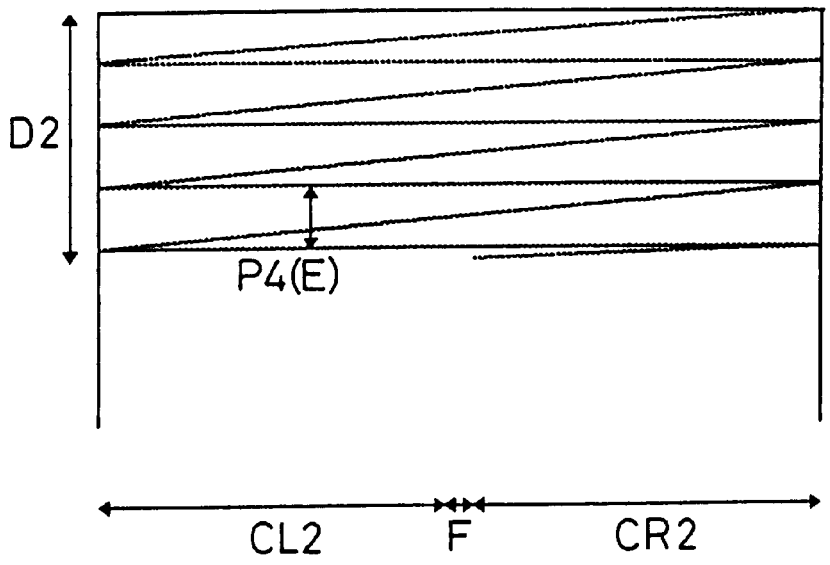
FIGS. 16(A) and 16(B) show a travelling route of the needle in forming a rear bar-tack stitch pattern on the return.
Figure 16B:
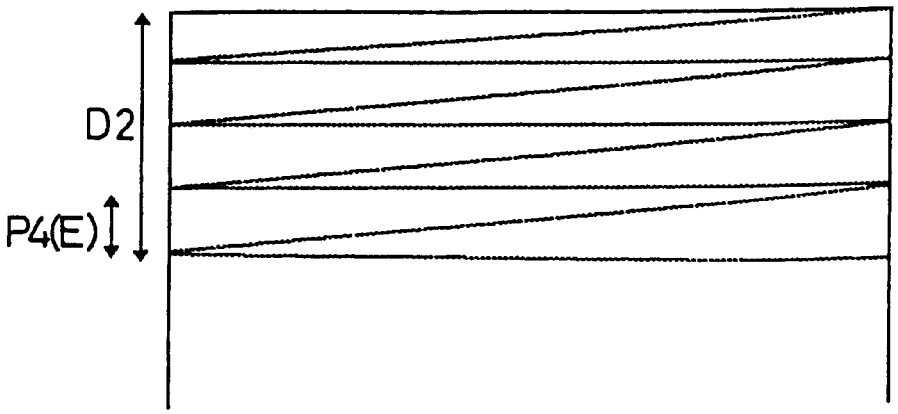

In case of N2=9 (odd), the needle points are represented with the following formulas and the travelling route of the needle 16 is as indicated with a solid line of FIG. 16(B).

First stitch=(−CL2−F/2, A+D1+D2+0.2−P4)

Second stitch=(CR2+F/2, A+D1+D2+0.2−P4)

Third stitch=(−CL2−F/2, A+D1+D2+0.2−2×P4)

Fourth stitch=(CR2+F/2, A+D1+D2+0.2−2×P4)

Fifth stitch=(−CL2−F/2, A+D1+D2+0.2 −3×P4)

Sixth stitch=(CR2+F/2, A+D1+D2+0.2 −3×P4)

Seventh stitch=(−CL2−F/2, A+D1+D2+0.2 −4×P4)

Eighth stitch=(CR2+F/2, A+D1)

In the above formulas, a limiting factor of N4≧2 is required.

At S35, the needle points at the right zigzag stitch 72 (hereinafter referred to as the zigzag stitch on the return)are calculated. The number of stitches for the zigzag stitch on the return N5 and its pitch P5 are indicated as follows:

N5≈2×A/B

P5=A/N5

At the zigzag stitch on the return, the shape of the pattern made from the needle points to be calculated varies depending on whether the number of stitch N5 is even or odd. In case of N5=10 (even), for example, the needle points are calculated using the following formulas and the travelling route of the needle 16 is as indicated with a solid line of FIG. 17(A).

First stitch=(F/2+CR, A+D1−P5)

Second stitch=(F/2, A+D1−2×P5)

Third stitch=(F/2+CR, A+D1−3×P5)

Fourth stitch=(F/2, A+D1−4×P5)

Fifth stitch=(F/2+CR, A+D1−5×P5)

Sixth stitch=(F/2, A+D1−6×P5)

Seventh stitch=(F/2+CR, A+D1−7×P5)

Eighth stitch=(F/2, A+D1−8×P5)

Ninth stitch=(F/2+CR, A+D1−9×P5)

Tenth stitch=(F/2, A+D1−10×P5)=(F/2, D1)

Wherein:

CR=2×zigzag width (03)×(1−zigzag width ratio (09) (3)

Figure 17A:
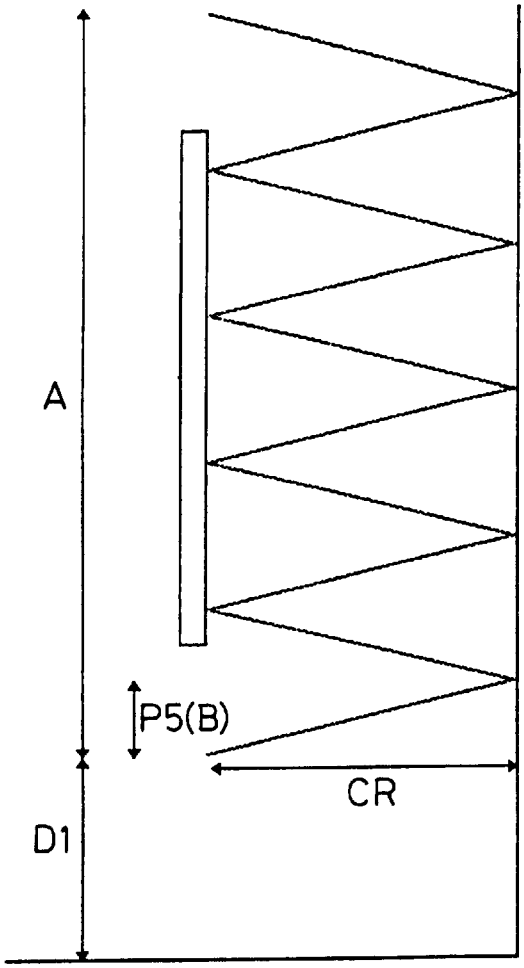
FIGS. 17(A) and 17(B) show a travelling route of the needle in forming a zigzag stitch pattern on the return.
Figure 17B:
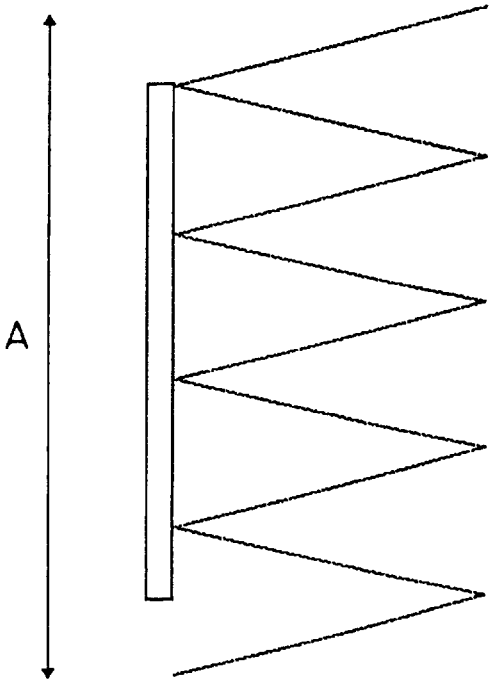

In case of N5=9 (odd), the needle points are indicated with the following formulas and the travelling route of the needle 16 is as indicated by the solid line of FIG. 17(B).

First stitch=(F/2, A+D1−P5)

Second stitch=(F/2+CR, A+D1−2×P5)

Third stitch=(F/2, A+D1−3×P5)

Fourth stitch=(F/2+CR, A+D1−4×P5)

Fifth stitch=(F/2, A+D1−5×P5)

Sixth stitch=(F/2+CR, A+D1−6×P5)

Seventh stitch=(F/2, A+D1−7×P5)

Eighth stitch=(F/2+CR, A+D1−8×P5)

Ninth stitch=(F/2, A+D1−9×P5)=(F/2, D1)

At S36, the needle points for the front bar-tack stitch portion 73 are calculated. The number of stitches for the front bar-tack stitch portion 73 N6 and its pitch P6 are indicated as follows:

N6≈2×D1/E

P6=D1/(N6/2)

Figure 18:
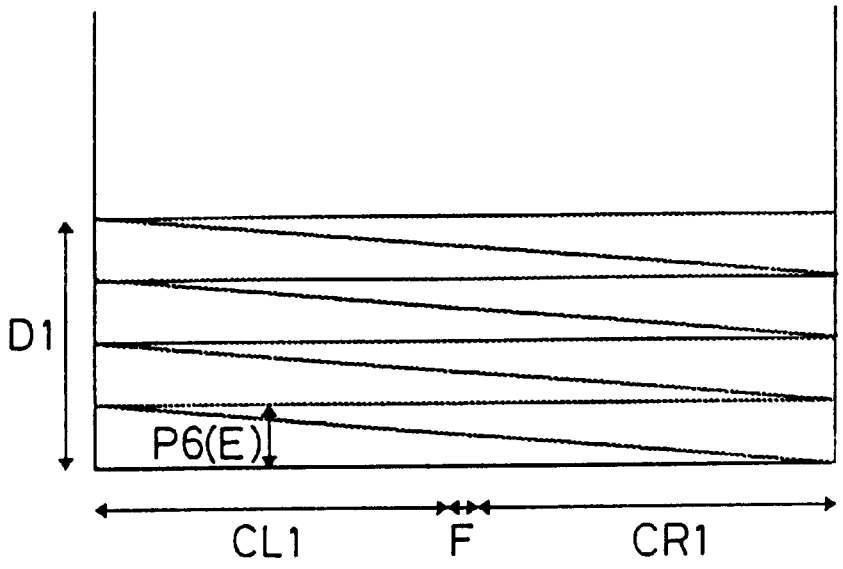
FIG. 18 shows a travelling route of the needle in forming a front bar-tack stitch pattern.

In case of N6=9, for example, the needle points are indicated using the following formulas and the travelling route of the needle 16 is as indicated with a solid line of FIG. 18.

First stitch=(CR1+F/2, D1)

Second stitch=(−CL1−F/2, D1)

Third stitch=(CR1+F/2, D1−P6)

Fourth stitch=(−CL1−F/2, D1−P6)

Fifth stitch=(CR1+F/2, D1−2×P6)

Sixth stitch=(−CL1−F/2, D1−2×P6)

Seventh stitch=(CR1+F/2, D1−3×P6)

Eighth stitch=(−CL1−F/2, D1−3×P6)

Ninth stitch=(CR1+F/2,0)

Wherein:

CR1=2×(zigzag width (03)+front bar-tack width correction (14))×(1−zigzag width ratio (09)).

A limiting factor of N6≧2 is required for the above formulas.

At S37, the needle points for the end backtack stitch (which are sewn at the end of sewing) are calculated. They are determined based on the setting value I2 for the number of end backtack stitches (11) as follows:

In case of (A) I2≧2

The pitch P6 is calculated using the following formula:

P6=(CL1+F/2)/(I2−1)

The needle points are indicated with the following formulas. In case of I2=3, for example, the travelling route of the needle 16 is as indicated with a solid line of FIG. 19(A). In case of I2=2, the travelling route of the needle 16 is as indicated with a solid line of FIG. 19(B).

First stitch=(0, 0)

Second stitch=(−P6, 0)

Third stitch=(−2×P6, 0)

I2th stitch=(−CL1−F/2, 0)

Figure 19A:
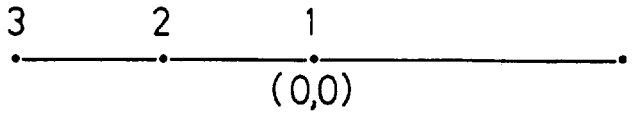
FIGS. 19(A)–19(C) show a travelling route of the needle at the end of sewing.
Figure 19B:
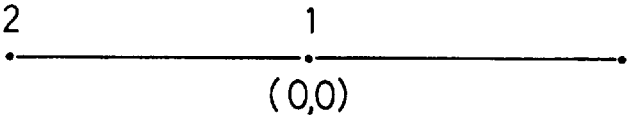
Figure 19C:
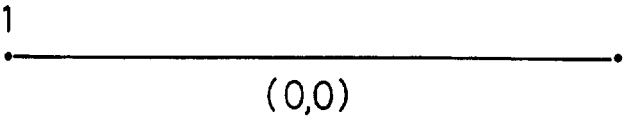

In case of I2=1, the needle point is expressed with the following formula, and the travelling route of the needle 16 is as indicated with a solid line of FIG. 19(C).

First stitch=(−CL−F/2, 0)

At S38, the needle point for the final stitch is calculated. It is indicated as follows:

(X, Y)=(0.5−CL1−F/2,−0.2)

Figure 20:
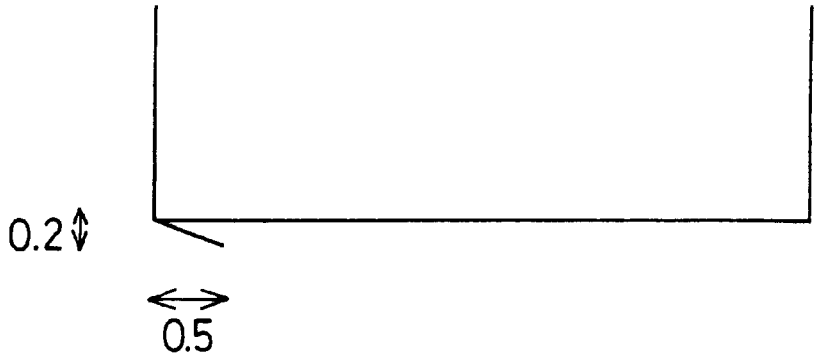
FIG. 20 shows a travelling route of the needle to the final stitch.

The travelling route of the needle 16 to the final stitch is as indicated with a solid line of FIG. 20. The needle point for the final stitch does not make an actual stitch when the needle and bobbin threads are cut because they are pulled downward below the work cloth and separated from the final needle point. At S39, the controller 5 creates the movement data in which the needle 16 is moved to the home position (0, 0). At S40, the controller 5 creates the end data to order the end of sewing (S15), and shifts to S5.

When any number except for 0 is set in "cutter X position correction (07)" or "cutter Y position correction (08)", the controller 5 performs the following steps at S5: when "cutter Y position correction (08)" is selected, its set value (mm) is converted to the number of stitches, and the timing to drive the solenoid 45 for driving the cutter is changed according to the number of stitches. This change enables the position at which the buttonhole 80 is formed to be shifted in the Y direction vis-a-vis the stitched buttonhole 70. When "cutter X position correction (07)" is selected, its set value is added to the movement amount of the first stitch made by the needle 16. This addition allows the entire set of needle points determined at S3 to be moved in the X direction, causing the position at which the buttonhole 80 is formed to be moved in the X direction vis-a-vis the stitched buttonhole 70.

Thus, in the sewing machine M, the values for "zigzag width (03)" and "zigzag width ratio (09)" can be set desirably from the formulas (2) and (3), so that the widths (CL, CR) of the left and right zigzag stitch portions 71,72 can be set separately. Therefore, not only the shape of the stitched buttonhole 70 can be minutely changed but, also, the balance between the left and right zigzag stitch portions 71,72 of the stitched buttonhole 70 can be adjusted.

Further in the sewing machine M, when the values for "front bar-tack width correction (14)" and "rear bar-tack width correction (15)" are set, the width at zigzag stitch portions 71,72 and the cutter space (CL+F+CR) and the width at the front or rear bar-tack stitch portions 73 or 74 (CL1+F+CR1 or CL2+F+CR2) can be set separately. Therefore, not only the shape of the stitched buttonhole 70 can be adjusted minutely but also the balance between the left and right zigzag stitch portions 71,72 and between the front and rear bar-tack stitch portions 73,74 can be adjusted. Moreover, in the sewing machine M, the width of the front bar-tack stitch portion 73 and the width of the rear bar-tack stitch portion 74 can be set separately, so that better balance can be achieved.

Because of the settings of "front bar-tack length correction (16)" and "rear bar-tack length correction (17)", the lengths of the bar-tack stitch portions 73,74 can be separately set. Therefore, the shape of the stitched buttonhole 70 can be minutely changed and the balance between the front and rear bar-tack stitch portion lengths of the stitched buttonhole 70 can be adjusted.

In the sewing machine M, there are various shapes for the stitched buttonhole 70 such as eyelet, boat form, and round or oval. The shapes are formable by the selection of the program number as described above. Furthermore, the zigzag stitch portions 71,72 can be sewn doubly. Thus, a stitched buttonhole 70 with decorative effect can be formed.

Next a description of step S3 when double sewing is carried out. To calculate the needle points for double sewing, there are two calculation methods: type A where additional steps corresponding to steps S35 and S32 are inserted between steps S32 and S33 of FIG. 11; and type B where the steps S32 to S36 are carried out twice consecutively (FIG. 11). In type A, the zigzag stitch portions 71,72 are sewn doubly as well as the front and rear bar-tack stitch portions 73,74 are predetermined to perform double sewing. In type B, the thickness of the stitched buttonhole 70 becomes almost doubled. When double sewing is set in parameter 20, either type of calculation method can be selected.

In other words, when the stitched buttonhole 70 is sewn doubly, the following modes are switched: a mode in which only the zigzag stitch portions 71,72 are sewn twice; and a mode in which bar-tack stitch portions 73,74 and the zigzag stitch portions 71,72 are sewn twice (in this mode, bar-tack stitch portions 73,74 are due to be sewn four times). Therefore, the balance in thickness of the zigzag stitch portions 71,72 and the bar-tack stitch portions 73,74 in the stitched buttonhole 70 can be easily adjusted.

As shown in FIGS. 13 and 18, the needle points for the start of the backtack stitch, calculated at S31, are disposed 0.2 mm in from the needle points for the front bar-tack stitch portion 73, calculated at S36. Therefore, during double sewing of the front bar-tack stitch portion 73, the needle thread already sewn into stitches can be effectively prevented from being cut. Similarly, as for double sewing of the rear bar-tack stitch portion 74, the needle points on the go can be disposed 0.2 mm in from the needle points on the return. Thus, the needle thread already sewn into stitches can be more securely prevented from being cut. However, the needle points at the start and the end of sewing are placed at the front bar-tack stitch portion 73, so that there is a high possibility that an error occurs in the needle points that form the actual stitches. In the sewing machine M, as to the front bar-tack stitch portion 73, the needle points on the go are placed 0.2 mm in, to prevent them from overlapping the needle points on the return. Therefore, the effect on the prevention of cutting the needle thread already sewn into stitches can still be achieved.

In the above embodiment, the sewing mechanism 10 corresponds to the sewing device, the controller 5 corresponds to the sewing controller, the up- and down-arrow keys 411 correspond to the zigzag width setting device, the stitch width setting device, the bar-tack length setting device, and the switching device. In detail, the up- and down-arrow keys 411, used when parameter number 03 or 09 is selected, correspond to the zigzag width setting device, the keys 411 used when parameter number 03, 14, or 15 is selected correspond to the stitch width setting device, the keys 411 used when parameter number 04, 16, or 17 is selected correspond to the bar-tack length setting device, and the keys 411 used when parameter number 20 is selected correspond to the switching device.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art. For example, the switching of programs and the settings of some parameters can be carried out using a DIP switch. The calculation of the needle points (S3) can be carried out separately from the stitch formation (S11). The calculation at S3 and the stitch formation at S11 can be performed at one time. If the calculation of the needle points at S3 is performed independently, it can be performed on a data creation device, such as a personal computer, which is separate from the sewing machine M.

What is claimed is:

1. A buttonhole sewing machine, comprising:

a feed bracket that feeds a work cloth;

a sewing device that forms stitches on the work cloth;

a sewing controller that controls the feed bracket and the sewing device to form a stitched buttonhole having a pair of zigzag stitch portions placed at both sides of a buttonhole and a pair of bar-tack stitch portions disposed at both ends of the zigzag stitch portions; and a zigzag stitch width setting device that enables the left and right zigzag stitch widths to be set separately, wherein the sewing controller controls the sewing device based on the zigzag stitch width set by the zigzag stitch width setting device so as to cause the sewing device to form the stitched buttonhole having the set zigzag stitch widths.

2. The buttonhole sewing machine according to claim 1, wherein the zigzag width setting device includes a display having associated means for adjusting the zigzag stitch width for each of the left and right zigzag stitch portions.

3. The buttonhole sewing machine according to claim 2, wherein the means for adjusting is a touch screen on the display.

4. The buttonhole sewing machine according to claim 3, further comprising a memory device having a default stitch width applicable to each of the left and right zigzag stitch portions.

5. The buttonhole sewing machine according to claim 2, further comprising a memory device having a default stitch width applicable to each of the left and right zigzag stitch portions.

6. The buttonhole sewing machine according to claim 4, wherein the default stitch width is increased or decreased by a predetermined increment each time an adjustment is indicated.

7. The buttonhole sewing machine according to claim 5, wherein the default stitch width is increased or decreased by a predetermined increment each time an adjustment is indicated.

8. A buttonhole sewing machine, comprising:

a feed bracket that feeds a work cloth;

a sewing device that forms stitches on the work cloth;

a sewing controller that controls the feed bracket and the sewing device so as to form a stitched buttonhole having a pair of zigzag stitch portions placed at both sides of a buttonhole and a pair of bar-tack stitch portions disposed at both ends of the zigzag stitch portions; and a stitch width setting device that enables a width for the pair of zigzag stitch portions and a width for the front or rear bar-tack stitch to be set separately, wherein the sewing controller controls the sewing device based on the zigzag stitch width set by the zigzag stitch width setting device so as to cause the sewing device to form the stitched buttonhole having the set zigzag stitch width.

9. A buttonhole sewing machine, comprising:

a feed bracket that feeds a work cloth;

a sewing device that forms stitches on the work cloth;

a sewing controller that controls the feed bracket and the sewing device so as to form a stitched buttonhole having a pair of zigzag stitch portions placed at both sides of a buttonhole and a pair of bar-tack stitch portions disposed at both ends of the zigzag stitch portions; and a bar-tack stitch length setting device that enables a length for each bar-tack stitch portion of the pair of bar-tack stitch portions to be set separately, wherein the sewing controller controls the sewing device based on the bar-tack stitch length set by the bar-tack stitch length setting device so as to cause the sewing device to form the stitched buttonhole having the set bar-tack stitch lengths.

10. A buttonhole sewing machine, comprising:

a feed bracket that feeds a work cloth;

a sewing device that forms stitches on the work cloth; and a sewing controller that controls the feed bracket and the sewing device so as to form a stitched buttonhole having a pair of zigzag stitch portions placed at both sides of a buttonhole and a pair of bar-tack stitch portions disposed at both ends of the zigzag stitch portions, wherein the sewing controller disposes needle points at the start of sewing and needle points at the end of sewing so as not to overlap each other when the start and the end of the stitched buttonhole are disposed on either of the front or rear bar-tack stitch portions and the front and rear bar-tack stitch portions are sewn doubly.

11. The buttonhole sewing machine according to claim 10, further comprising a mode switching device that switches over a mode in which only the zigzag stitch portions are sewn doubly and a mode in which both bar-tack stitch portions and the zigzag stitch portions are sewn doubly when the stitched buttonhole is sewn doubly.

12. A buttonhole sewing machine, comprising:

a feed bracket that feeds a work cloth;

a sewing device that forms stitches on the work cloth;

a sewing controller that controls the feed bracket and the sewing device to form a stitched buttonhole having a pair of zigzag stitch portions, a zigzag stitch portion on each side of a buttonhole area, and a pair of bar-tack stitch portions, a bar-tack stitch portion at each end of the buttonhole area and the zigzag stitch portions; and means for setting sewing criteria for each zigzag stitch portion and each bar-tack stitch portion.

13. The buttonhole sewing machine according to claim 12, further comprising a buttonhole cutter for cutting a buttonhole in the buttonhole area.

14. The buttonhole sewing machine according to claim 12, wherein the means for setting permits setting a zigzag stitch width for each zigzag stitch portion.

15. The buttonhole sewing machine according to claim 14, wherein the means for setting permits setting a length of the pair of zigzag stitch portions.

16. The buttonhole sewing machine according to claim 12, wherein the means for setting permits setting a bar-tack stitch width for each bar-tack stitch portion.

17. The buttonhole sewing machine according to claim 16, wherein the means for setting permits setting a length for each bar-tack stitch portion.

18. The buttonhole sewing machine according to claim 15, wherein the means for setting permits setting a bar-tack stitch width for each bar-tack stitch portion.

19. The buttonhole sewing machine according to claim 18, wherein the means for setting permits setting a length for each bar-tack stitch portion.

20. The buttonhole sewing machine according to claim 12, wherein the means for setting permits setting a width of the buttonhole area.

21. The buttonhole sewing machine according to claim 12, wherein the means for setting allows designation of double stitching for at least one of the pair of zigzag stitch portions and the pair of bar-tack stitch portions.

22. The buttonhole sewing machine according to claim 15, wherein the means for setting allows designation of double stitching for at least one of the pair of zigzag stitch portions and the pair of bar-tack stitch portions.

23. The buttonhole sewing machine according to claim 19, wherein the means for setting allows designation of double stitching for at least one of the pair of zigzag stitch portions and the pair of bar-tack stitch portions.

24. The buttonhole sewing machine according to claim 21, further comprising stitch development means for developing stitches so end points of stitches do not overlap when double sewing is set.

* * * * *